US006601588B1

(12) United States Patent
Baltierra et al.

(10) Patent No.: US 6,601,588 B1
(45) Date of Patent: Aug. 5, 2003

(54) PEDICURE FILE WITH REMOVABLE HANDLE

(75) Inventors: Julie Baltierra, Mill Creek, WA (US); Gavril A. Horvath, Tarzana, CA (US)

(73) Assignee: OPI Products, Inc., N. Hollywood, CA (US)

( * ) Notice: Subject to any disclaimer, the term of this patent is extended or adjusted under 35 U.S.C. 154(b) by 0 days.

(21) Appl. No.: 09/900,727

(22) Filed: Jul. 6, 2001

(51) Int. Cl.[7] ..... A45D 29/18; A45D 29/04
(52) U.S. Cl. ..... 132/76.5; 132/76.4; 132/75.6
(58) Field of Search ..... 132/76.5, 76.4, 132/75.6, 75.3, 73.5, 150; 16/422, 425; 30/26; 451/557

(56) References Cited

U.S. PATENT DOCUMENTS 190,989 A * 5/1877 Stewart ..... 30/26
205,088 A * 6/1878 Hollman ..... 30/26
218,391 A * 8/1879 Mc Donald ..... 30/26
791,484 A * 6/1905 Mertin ..... 132/76.5
973,308 A * 10/1910 Ruettgers ..... 30/26
1,043,699 A * 11/1912 Hoppe ..... 132/76.5
1,700,076 A * 1/1929 Riggsbee ..... 132/76.4
2,376,946 A * 5/1945 Stinson ..... 132/76.4
2,390,381 A * 12/1945 McRoberts et al. ..... 132/76.4
2,461,781 A * 2/1949 Sorrell ..... 132/76.5
D257,541 S * 11/1980 Fox et al. ..... 132/76.4
5,261,430 A * 11/1993 Mochel ..... 132/322

* cited by examiner

*Primary Examiner*—John J. Wilson
*Assistant Examiner*—Robyn Kieu Doan
(74) *Attorney, Agent, or Firm*—Blakely, Sokoloff, Taylor & Zafman

(57) ABSTRACT

A method and apparatus for tooling and locking a handle to a pedicure blade is disclosed. The method and apparatus member presents an entire surface of the pedicure member to be available for use, the curving of the surface allows easy access to calluses in hard to reach areas, the blade thus may be sanitized in a disinfectant and the size of the blade is more convenient for storage.

27 Claims, 7 Drawing Sheets

PEDICURE FILE WITH REMOVABLE HANDLE

FIELD OF THE INVENTION

This invention relates to cosmetology devices. More specifically, it relates to a pedicure file.

BACKGROUND

Pedicure devices are used to beautify and cleanse feet. One such device is a pedicure file. Pedicure files have abrasive surfaces of various levels of roughness, much like various grades of sandpaper. A measure of roughness of the abrasive surface of a pedicure file is called grit. Grit of common pedicure file surfaces typically run from 60 to 400. The abrasive particles of pedicure files are roughest with a grit of 60 and finest with a grit of 400.

Pedicure abrasive surfaces are typically placed on some backing material to form a pedicure file. The backing material provides the pedicure file with structural rigidity. Pedicure files are typically used to gently abrade the surface of the foot, removing dead skin particles and reducing the size of calluses. In the case of removing calluses, several different pedicure files with different grits will be used. Work on the callus will begin with a pedicure file having a smaller grit and therefore a rougher surface, gradually moving on up through the grit sizes, reducing the roughness of the abrasive surface on the pedicure file as the callus is removed.

The difficulty with typical pedicure files is that the area of the pedicure file covered by the hands of the pedicure technician is not available to use in an abrasive manner against the skin, and thus part of the surface area of the abrasive material is unavailable for use.

BRIEF DESCRIPTION OF THE DRAWINGS

The invention is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

DETAILED DESCRIPTION

Reference will now be made to drawings wherein like structures will be provided with like reference designations.

In order to show the structures of the claims most clearly, the drawings included herein are diagrammatic representations of indicated structures. Thus, the actual appearance of the fabricated structures, for example in a photograph, may appear different while still incorporating essential structures of the claims. Moreover, the drawings show only the structures necessary to understand the claims. Additional structures known in the art have not been included to maintain the clarity of the drawings.

Figure 1:
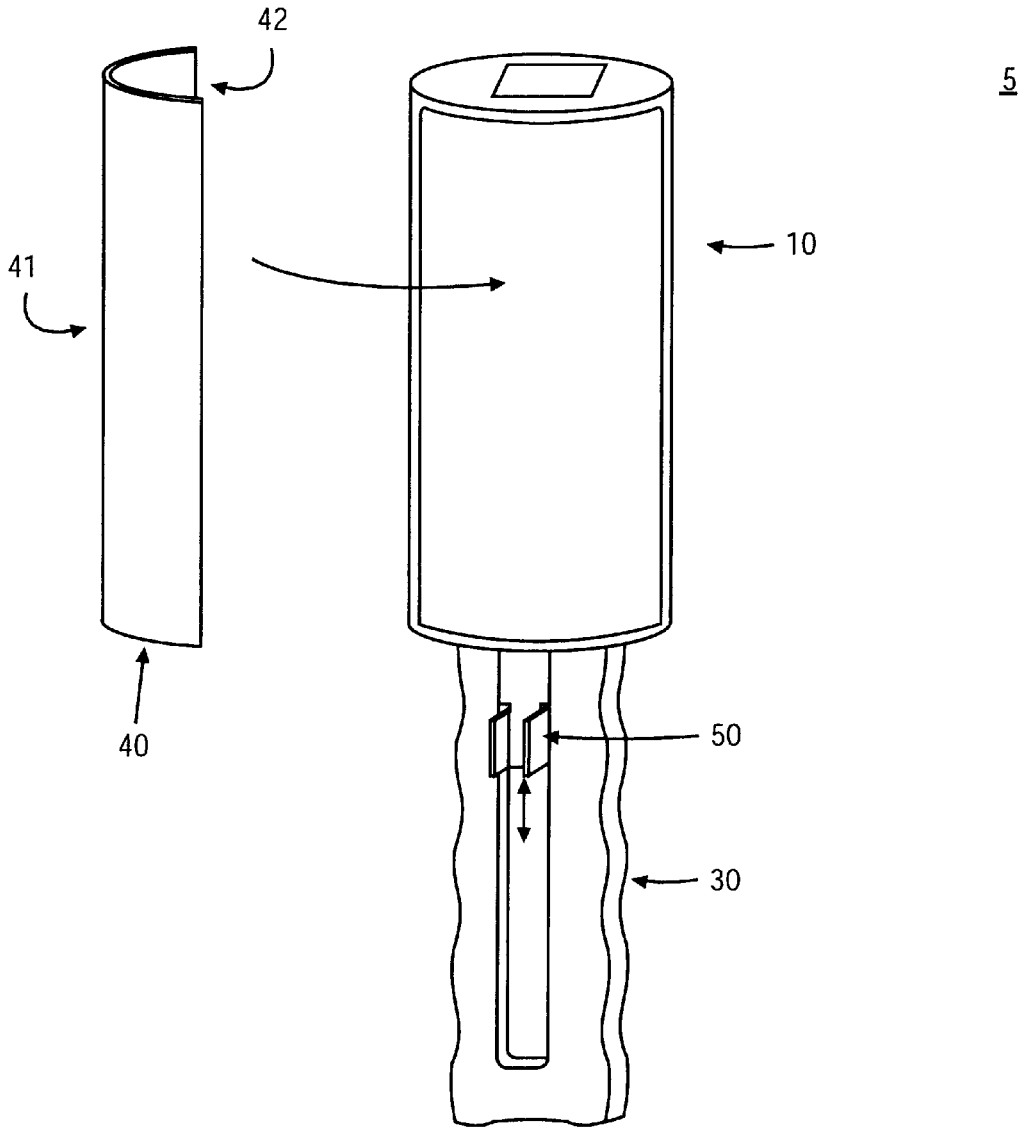
FIG. 1 is a schematic illustration of an apparatus including a pedicure blade, insert and handle.

FIG. 1 illustrates one embodiment of a cosmetic apparatus, such as a pedicure file, with a detachable handle. In the illustration pedicure file 5 includes four components: blade 10, handle 30 pedicure member 40 and insert 50. To assemble the components, handle 30 is placed in a cavity in blade 10. Insert 50 is placed within arm portions of handle 30 such that it can be moved towards blade 10 along the inside arm portion lengths of handle 30 and firmly wedge handle 30 into place, locking handle 30 to blade 10. Pedicure member 40 may be adhered to a surface of blade 10.

Figure 2:
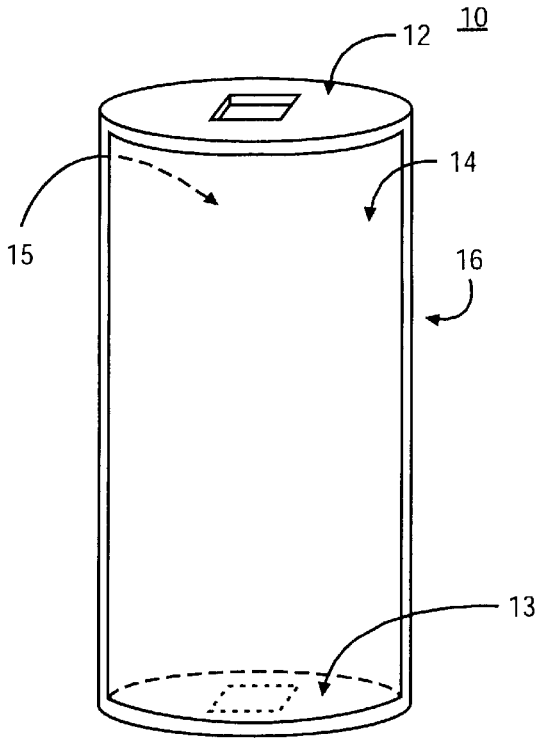
FIG. 2 is a schematic illustration of the pedicure blade of the apparatus of FIG. 1.
Figure 2A:
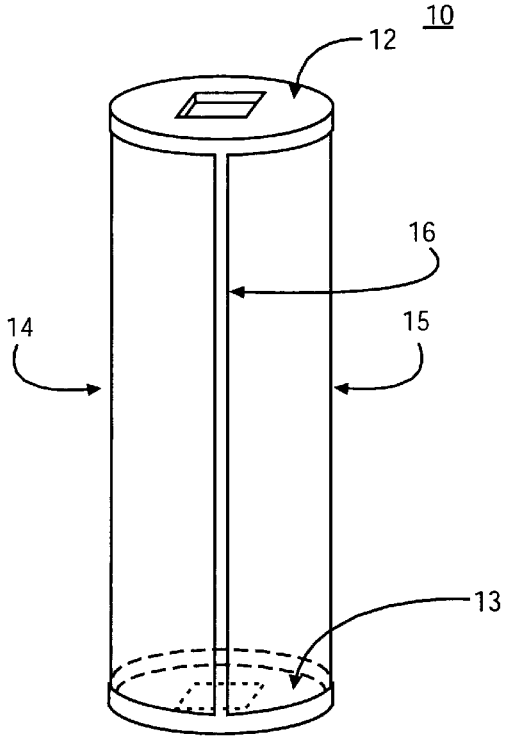
FIG. 2A is a schematic illustration of the blade of FIG. 2 rotated 90°.

FIG. 2 is an illustration of one embodiment of blade 10 of the pedicure file of FIG. 1. Blade 10 has first side 14 and a second side 15 that are each capable of containing a pedicure member. According to one embodiment each side 14 and 15 of blade 10 has an area (length X width) on the order of five inches (about 12.5 centimeters) by two inches (about 5 centimeters).

Pedicure member 40 is similar to a piece of sandpaper. Pedicure surface 41 on a second side of pedicure member 40 contains an abrasive surface of various textures. One measure of texture is grit. On one extreme, a grit of 60 has a rough texture, and on the other extreme, a grit of 400 has the fine texture. First side 42 of pedicure member 40 comprises a surface suitable for adhering pedicure member 40 to first side 14 or second side 15 of pedicure blade 10 with an adhesive. Adhesives include a relatively permanent adhesive such as an adhesive substance (e.g. glue) and a non-permanent adhesive such as a hook and loop fastening system.

Typically, a single pedicure blade such as blade 10 may have pedicure members of differing grit. For example, in one embodiment, the pedicure member on first side 14 of blade 10 could have a grit of 80 while the pedicure member on second side 15 of blade 10 could have a finer grit of 120. There can be other combinations for other embodiments of the blade handle. One purpose of having two sides to a single blade is so there are two levels of grit in a single tool. Having two levels of grit in a single tool allows the rougher grit to do the initial work of removing calluses and surface skin and the relatively finer grit to do the clean-up work.

Both first side 14 and second side 15 of pedicure blade 10 in FIG. 2 have a perimeter guard 16. Perimeter guard 16 extends around first side 14 and second side 15. The perimeter guard provides protection against contact with the edge of the pedicure member. The edge of the pedicure member is typically a very tough and jagged material similar to the backing paper of sandpaper.

Blade 10 includes first end surface 12, and second end surface 13 opposite to first end surface 12. End surfaces 12 and 13 each define a cavity within them that allows handle 30 to be inserted and engage the cavity. Blade 10 can be attached to handle 30 on either end surface 12 or 13 by means of the cavity defined in the end surface. First end surface 12 is illustrated in FIG. 2 as is second end surface 13 at a distal end of the blade from first end surface 12. One advantage to this pedicure blade is that the entirety of the pedicure member placed in either first side 14 or second side 15 is available for pedicure filing. In this regard, entirety includes the entire surface of a pedicure member exclusive of the edge of the pedicure member which is surrounded by perimeter guard 16. By removing the necessity to place the hand over a portion of the pedicure member, the fraction of that pedicure member available for filing has been increased. In one embodiment, the entirety of the pedicure member is available for use, because, for example, handle 30 can be removed from the cavity defined by first end surface 12, blade 10 may be rotated 180 degrees and handle 30 may be inserted in the cavity defined by second end surface 13 of blade 10.

An advantage of one embodiment of the blade having circular or oval first end surface 12 and second end surface 13 is a conformal shape to the outer surface of the pedicure member given by the circular or oval shapes of the first and second end surfaces. This conformal shape allows better access to contours in the outer surface of the skin of a foot. A contoured pedicure member will be better able to access these contours in the skin of a foot than a flat pedicure file.

An advantage of one embodiment of this detachable pedicure blade 10 is smaller storage area required to store blade 10. With blade 10 removed from pedicure handle 30, blade 10 can be stored in approximately half of the space required by a full blade with handle 5. This reduction in the storage required per blade 10 is especially valuable in a commercial setting where there may be multiple customers to a single pedicure technician. The pedicure technician may, in one embodiment, keep the handle with themselves, while storing the blade in a reduced storage area dedicated to a particular client.

An advantage of one embodiment of having a removable pedicure blade 10 is that each blade 10 can be individually sanitized. Sanitizing blade 10 may reduce the transmission of any contamination from starting with one customer and transferring to another customer. The sanitation process can be accomplished by submerging the blade in a disinfectant solution for approximately 10 to 11 minutes. One such disinfectant solution is "Swiss Guard"™ distributed by OPI Incorporated of North Hollywood, Calif. This solution is a combination of disinfectants and cleaners specifically designed for use with pedicure blades.

Figure 3:
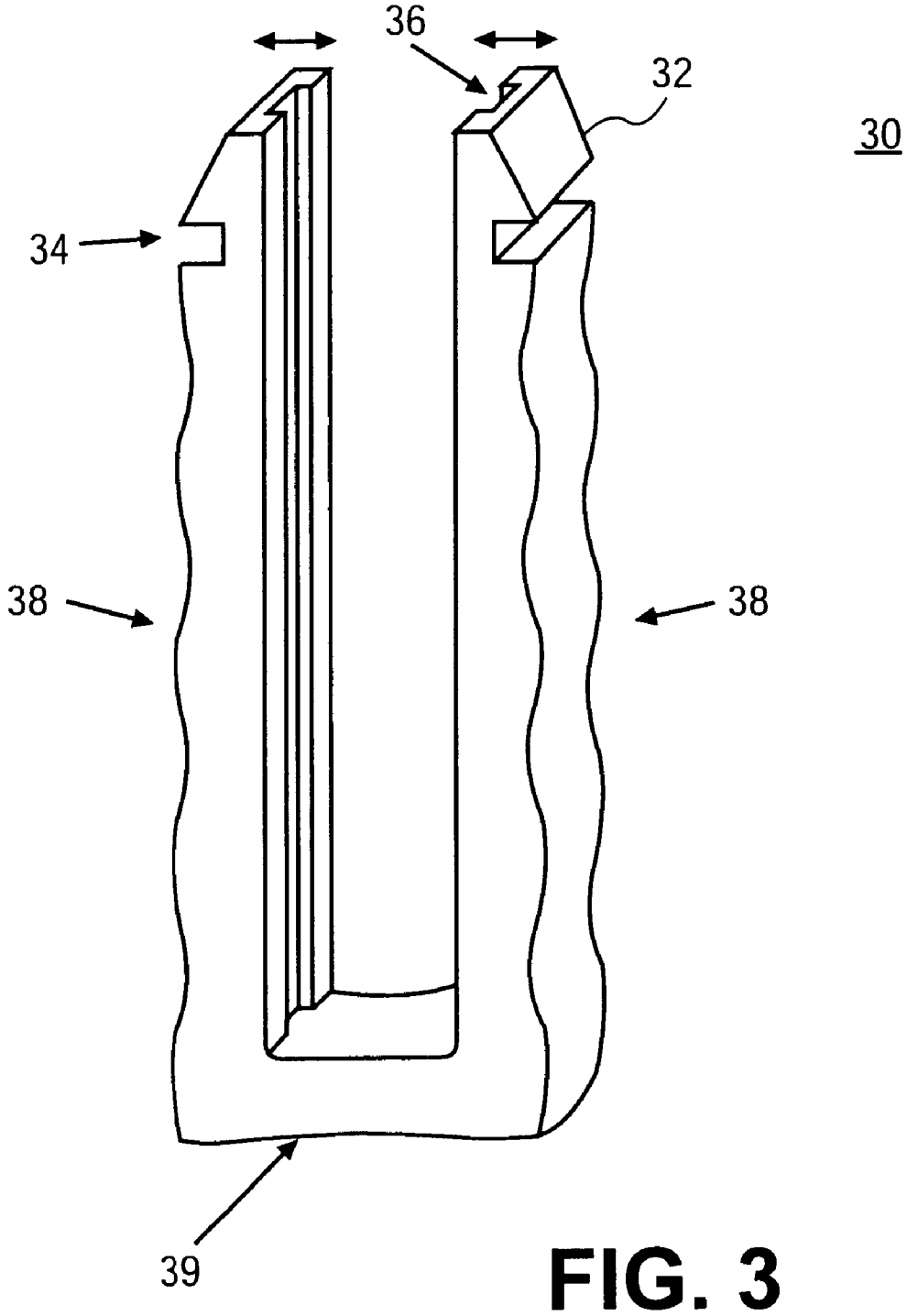
FIG. 3 is a schematic illustration of a pedicure blade handle of the apparatus of FIG. 1.

FIG. 3 illustrates pedicure handle 30. Pedicure handle 30 has two handle arms 38 that are at one end connected together by base 39 and while largely parallel, are free at the opposite end from base 39 to flex. In one example, flexing handle arms 38 would allow the ends of handle arms 38 that are free to move to be able to fit into a space or cavity smaller than they would be able to fit into otherwise, in an unflexed state. Adjacent the free ends of handle arms 38 are guiding edges 32 (e.g. inwardly tapered or angled edges) on either handle arm that allow for smoother insertion of handle arms 38 into a cavity of blade 10 defined by either first end surface 12 or second end surface 13. Handle arms 38 each have a locking notch 34 formed therein approximately at an end position. Locking notch 34 allows handle arms 38 on relaxation of flexure to engage the cavity through which guiding edges 32 are inserted (e.g. a cavity of blade 10 defined by end surfaces 12 and 13).

In one embodiment, handle arms 38 each have groove 36 on an inner portion thereof. Grooves 36 provide a track for an object such as insert 50 described below, to move within. Grooves 36 run the length of handle arm 38. In one embodiment, grooves 36 may have a stop to prevent insert 50 from being completely separated from handle 30. One such stop is a cap at the free ends of each handle arm 38 over groove 36.

Handle arms 38 are designed and sized for the comfort of and solid grip by the pedicure technician as required when performing a pedicure. Handle 30 may be fabricated from, but is not limited to, polypropylene or other plastically deformable structural materials. In one embodiment, handle 30 including guiding edges 32, locking notches 34, grooves for insert 36 handle arms 38 and base 39 may be formed in a single mold. In FIG. 3, handle arms 38 are formed with indentations corresponding to fingers of an adult human hand.

Guiding edge 32, when handle arms 38 are flexed towards each other in one embodiment, better enable the handle to enter the cavity defined by first end surface 12 or second end surface 13 in FIG. 2. When the flexure of handle arms 38 is released, locking notches 34 are able to engage the sides of the cavity defined by first end surface 12 or second end surface 13 in FIG. 2.

Figure 4:
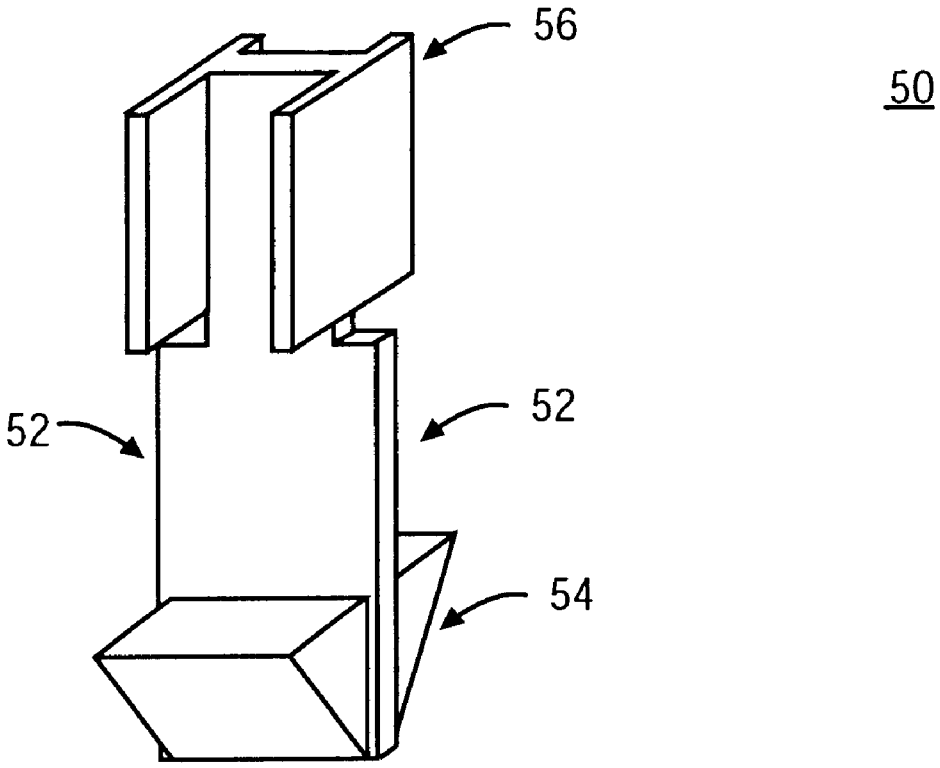
FIG. 4 is a schematic illustration of the pedicure blade handle insert of the apparatus of FIG. 1.

FIG. 4 illustrates an insert that can be placed in handle 30. Insert 50 has a handle groove tongue 52 on either side that fits into the groove for insert 36 of FIG. 3. Handle groove tongue 52 allows insert 50 to slide up and down the interior of handle 30. Finger grips 56 give the person assembling the pedicure blade somewhere to grab so that insert 50 can be moved up and down in grooves 36 of handle 30 in FIG. 3. Contact wedges 54 on either side of insert 50 fill the remainder of the cavity defined by first end surface 12 or second end surface 13 left by the locking end of handle arms 38 of handle 30. By pushing insert 50 up into contact with blade 10, blade 10 locks on handle 30; and squeezing handle 30 will not be possible. Sliding insert 50 into that portion of the cavity defined by first end surface 12 or second end surface 13 remaining open by the blade after the flexing of the blade is released, allows avoiding the accidental release of the blade as a pedicure is being performed. To release blade 10, insert 50 needs to be moved towards the base 39 of handle 30. In this way the handle, when squeezed, can be removed from the blade.

Figure 5:
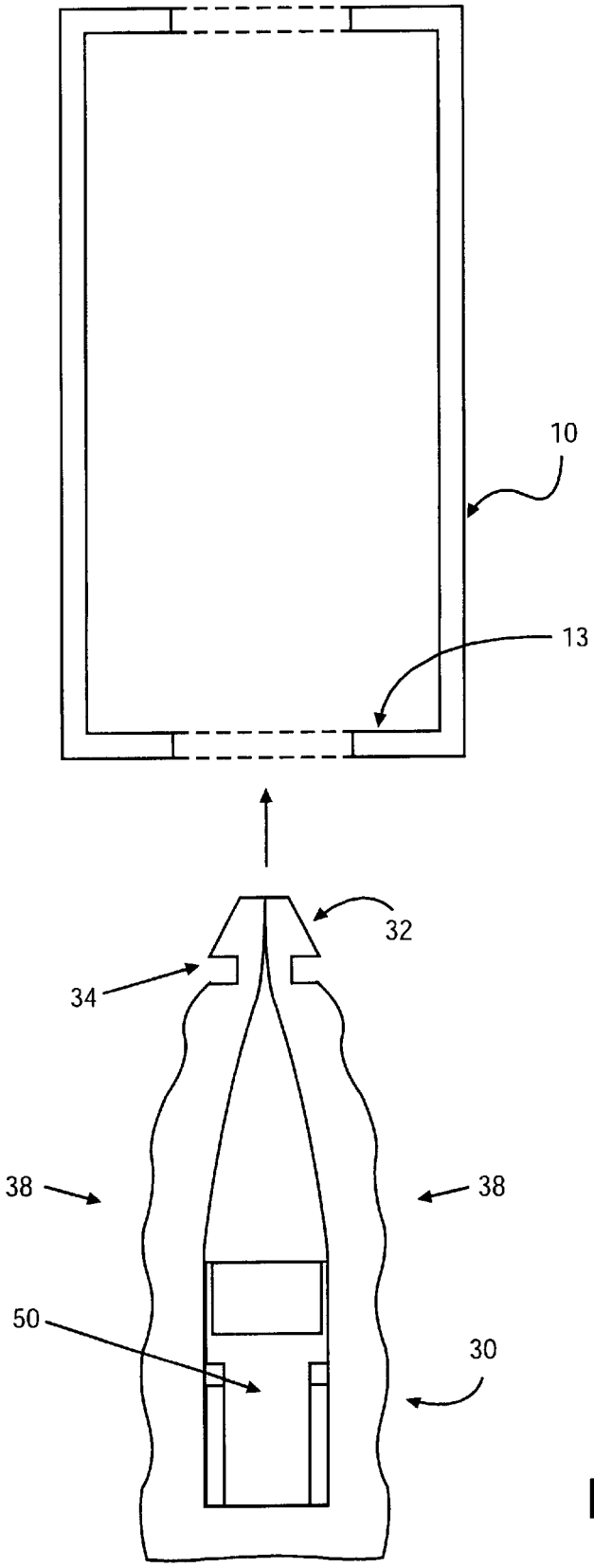
FIG. 5 is a cross-sectional schematic side view of flexed handle just prior to insertion into the cavity defined by an end surface of the blade.

FIG. 5 is a cross-sectional schematic side view of flexed handle 30 just prior to insertion into the cavity defined by an end surface 13 of the blade 10. In one embodiment, the free ends of handle arms 38 are flexed together to allow them to enter the cavity defined by end surface 13 of blade 10. Insert 50 is positioned at the far end of handle arms 38 from notches 34. This positioning of insert 50 allows maximum flexing of free end of handle arms 38. Handle 30 is introduced into the cavity defined by end surface 13 of blade 10 while in flexed position. Guiding edges 32 on the free ends of handle arms 38 help introduce the free ends of handle arms 38 into the cavity defined by end surface 13.

Figure 6:
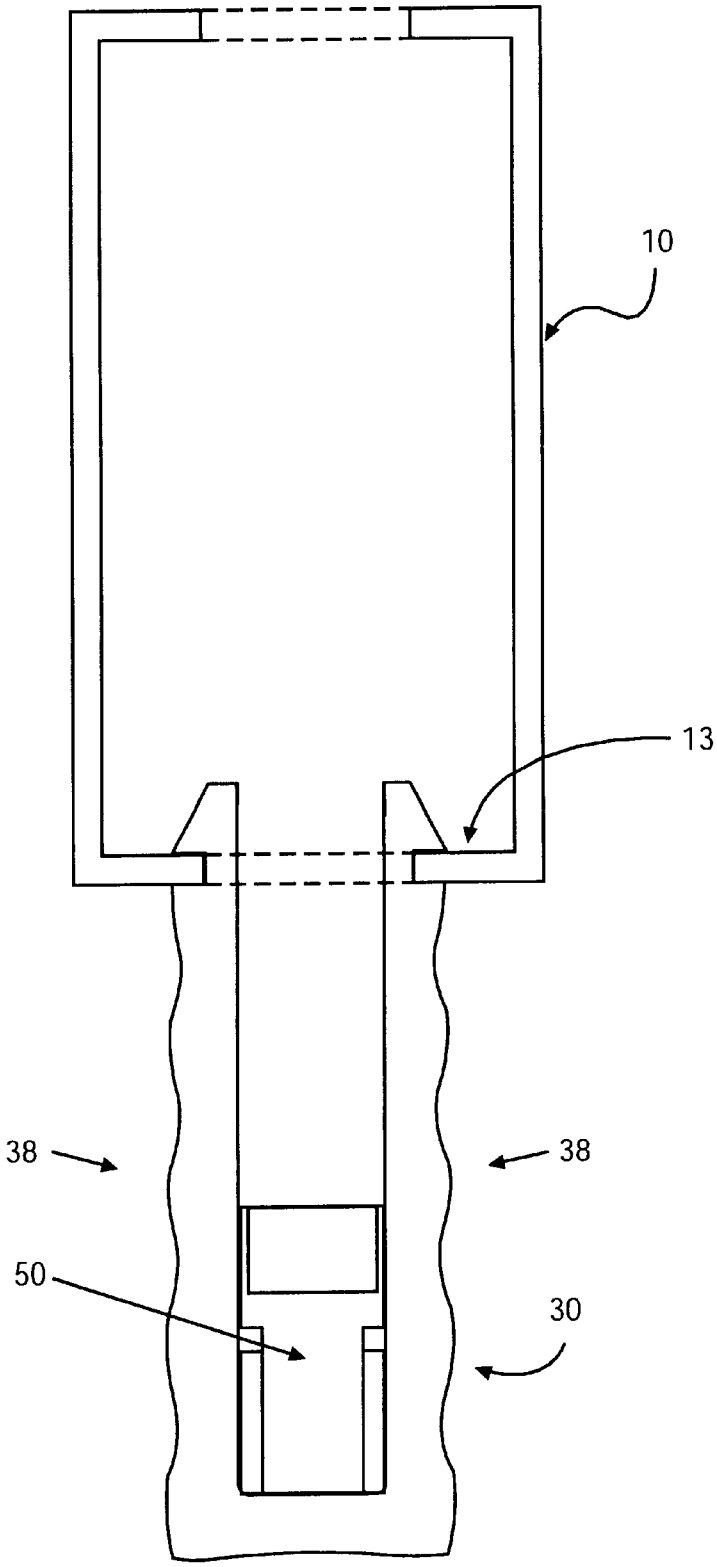
FIG. 6 is a cross-sectional schematic side view of the unflexed handle as it engages the cavity defined by an end surface of the blade.

FIG. 6 is a cross-sectional schematic side view of the unflexed handle 30 as it engages the cavity defined by end surface 13 of blade 10. In the unflexed or relaxed state handle arms 38 resume their relaxed distance from one another, allowing notches 34 to engage the edge of the cavity defined by end surface 13. In the relaxed state, handle arms 38 are again substantially parallel, allowing insert 50 to move the entire length of the handle 30.

Figure 7:
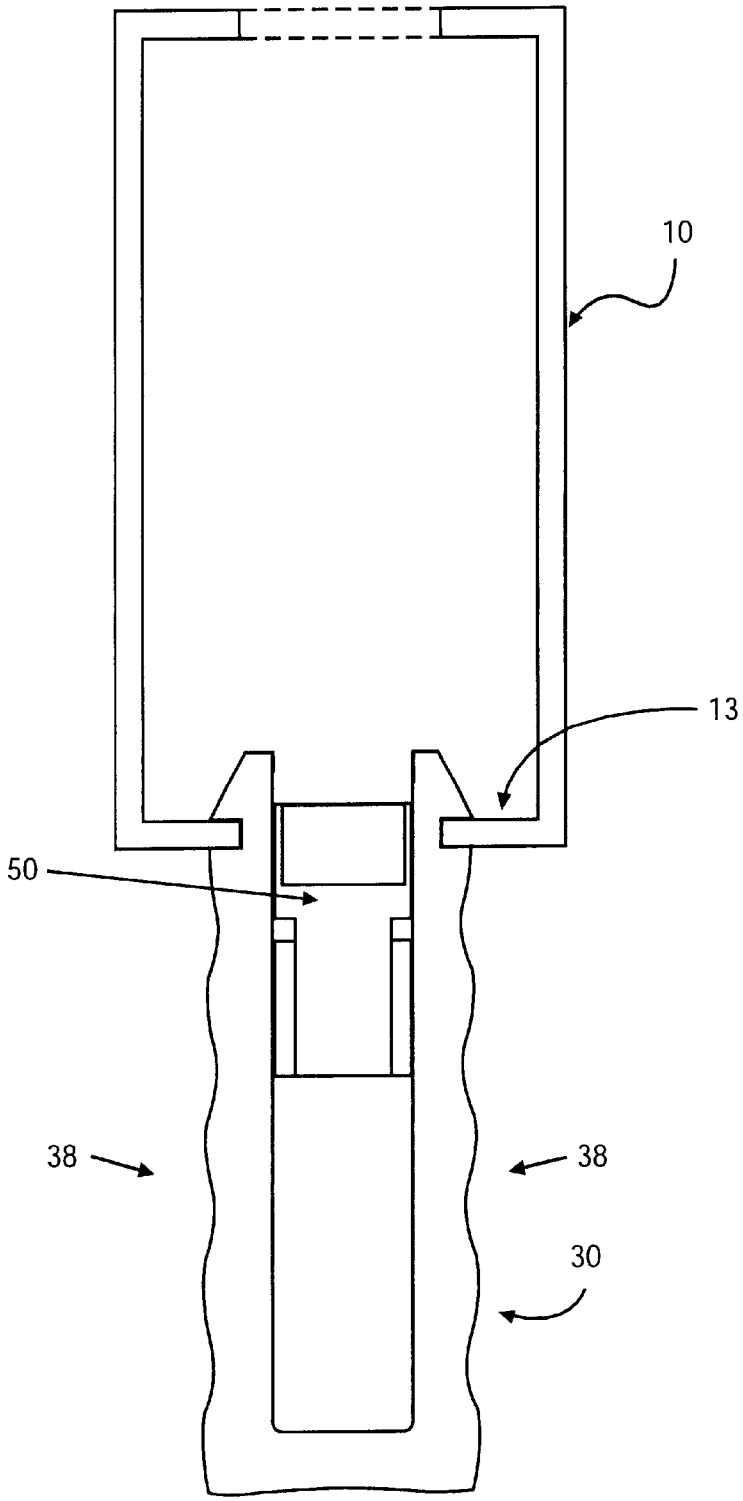
FIG. 7 is a cross-sectional schematic side view of the unflexed handle with the insert locking the handle inside the cavity defined by an end surface of the blade.

FIG. 7 is a cross-sectional schematic side view of relaxed handle 30 with insert 50 locking handle 30 inside the cavity defined by end surface 13 of blade 10. In one embodiment, insert 50 is moved through the interior of handle 30, between handle arms 38, to it is in contact with both handle arms 38 of handle 30, and end surface 13 of blade 10. Insert 50 fills the remainder of the cavity defined by end surface 13 that is left unfilled by relaxed handle arms 38. Contacting end surface 13 of blade 10 allows insert 50 to force handle arms 38 to remain in the unflexed state. Remaining in the unflexed state, locks handle 30 to blade 10.

In the preceding detailed description, the invention is described with reference to specific embodiments thereof. It will, however, be evident that various modifications and changes may be made thereto without departing from the broader spirit and scope of the invention as set forth in the claims. The specification and drawings are, accordingly, to be regarded in an illustrative rather than a restrictive sense.

What is claimed is:

1. An apparatus comprising:

a pedicure blade;

a pedicure blade handle comprising a base and a pair of arm portions extending from the base the arm portions coupled to the pedicure blade; and a locking insert disposed between the arm portions of the handle such that the insert is slidable up and down at least a portion of an interior of the handle and in a first position coupled to the pedicure blade for releasably locking the handle to the blade, wherein the blade has a first side and a second side, a first end surface and a second end surface opposite to the first end surface, the first side and the second side each defining a pedicure surface, and at least one of the first end surface and the second end surface defining a cavity therein.

2. The apparatus of claim 1, further comprising a pedicure member comprising a first side and a second side wherein the first side is coupled to the pedicure surface of the pedicure blade.

3. The apparatus of claim 2, wherein the second side of the pedicure member presents an entire surface to use as pedicure surface.

4. The apparatus of claim 2, further comprising a perimeter guard coupled to the first side and the second side of the blade to protect against contact with a edge of the pedicure member.

5. The apparatus of claim 1, wherein the pedicure member comprises a first pedicure member coupled to the first side of the pedicure blade, the apparatus further comprising a second pedicure member comprising a first side and a second side wherein the first side is coupled to the second side of the pedicure blade.

6. The apparatus of claim 5, wherein the second side of each of the first pedicure member and the second pedicure member comprises a texture defined by a grit and the grit of the first pedicure member is different than the grit of the second pedicure member.

7. The apparatus of claim 1, wherein the blade handle comprises: a first and second handle arm positioned substantially parallel to each other flexibly coupled to a common base.

8. The apparatus of claim 7, wherein the first and second arms flex altering the distance between them at the distal end from the base, this flexing allowing the handle arms to be placed in the cavity in the end surface of the blade.

9. The apparatus of claim 8, wherein a notch in the first and second arms of the handle engage the cavity of the blade when the flexing of the arms is released.

10. The apparatus of claim 7, wherein the first and second arms have a groove running along a length of a side for guiding the insert.

11. The apparatus of claim 10, wherein when the handle arms are engaged in the cavity of the blade, the insert can slide up the handle into a space in the cavity locking the handle firmly to the blade.

12. The apparatus of claim 1, wherein the blade handle comprises: a first and second handle arm positioned parallel to each other flexibly molded integrally to a common base.

13. The apparatus of claim 12, wherein the first and second arms flex altering the distance between them at the distal end from the base this flexing allowing the handle arms to be placed in the cavity in an end surface of the blade.

14. The apparatus of claim 13, wherein a notch in the first and second arms of the handle engage the cavity of the blade when the flexing of the arms is released.

15. The apparatus of claim 2, wherein the first and second arms have a groove running along a length of a side for guiding the insert.

16. The apparatus of claim 15, wherein when the handle arms are engaged in the cavity of the blade, the insert can slide up the handle into a space in the cavity locking the handle firmly to the blade.

17. The apparatus of claim 2, wherein at least one of the first end surface and the second end surface forms an oval thereof.

18. An apparatus comprising:

a pedicure blade;

a pedicure blade handle comprising a base and a pair of arm portions extending from the base the arm portions coupled to the pedicure blade; and a locking insert disposed between the arm portions of the handle such that the insert is slidable up and down at least a portion of an interior of the handle and in a first position coupled to the pedicure blade for releasably locking the handle to the blade, wherein the insert is removable from the handle.

19. A method comprising:

flexing a pair of handle arms on a handle;

positioning the pair of handle arms in a cavity in a pedicure blade;

releasing the pair of handle arms from the flexed position;

sliding an insert into the remainder of the cavity left by the handle arms; and locking the handle arms in place in the blade.

20. The method of claim 19, wherein flexing the pair of handle arms moves their ends away from one another.

21. The method of claim 19, wherein flexing the pair of handle arms moves their towards one another.

22. The method of claim 19, wherein the insert is removable from the handle.

23. An apparatus comprising:

a pedicure blade having a cavity portion defined by an end surface thereof, a handle and an insert;

means for engaging the cavity portion of the pedicure blade with the handle; and means for releasably locking the handle to the cavity portion of the blade.

24. The apparatus of claim 23, wherein the means for engaging the pedicure blade comprises:

handle arms having notches disposed therein near a free end of handle arms for engaging the cavity of the blade.

25. The apparatus of claim 23, wherein the means for locking the handle to the blade comprises:

moving the insert from an end of the handle near a base of the handle to an end of the handle opposite the base in contact with an end surface of the blade to prevent the handle arms from flexing.

26. An apparatus comprising:

a pedicure blade;

a pedicure blade handle comprising a base and a pair of arm portions extending from the base the arm portions coupled to the pedicure blade; and a locking insert disposed between the arm portions of the handle such that the insert is slidable up and down at least a portion of an interior of the handle and in a first position coupled to the pedicure blade for releasably locking the handle to the blade, wherein the locking insert is configured such that, by sliding the locking insert up the interior of the handle towards the blade, the handle releasably locks to the pedicure blade and, by sliding the locking insert down the interior of the handle away from the blade, the handle is released from the pedicure blade.

27. An apparatus comprising:

a pedicure blade;

a pedicure blade handle comprising a base and a pair of arm portions extending from the base the arm portions coupled to the pedicure blade; and a locking insert disposed between the arm portions of the handle such that the insert is slidable up and down at least a portion of an interior of the handle and in a first position coupled to the pedicure blade for releasably locking the handle to the blade, wherein the pedicure blade includes a first opening portion and a second opening portion formed opposite to the first opening portion, said first and second opening portions are configured to receive at least a portion of the pedicure blade handle to enable the handle to be releasably secured to either end of the pedicure blade.

* * * * *